US009315010B2

(12) United States Patent
Mitani

(10) Patent No.: US 9,315,010 B2
(45) Date of Patent: Apr. 19, 2016

(54) THERMAL STENCIL-MAKING MACHINE

(71) Applicant: RISO KAGAKU CORPORATION, Tokyo (JP)

(72) Inventor: Koki Mitani, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/828,075

(22) Filed: Aug. 17, 2015

(65) Prior Publication Data

US 2016/0046117 A1 Feb. 18, 2016

(30) Foreign Application Priority Data

Aug. 18, 2014 (JP) ..... 2014-165925

(51) Int. Cl.
*B41C 1/14* (2006.01)

(52) U.S. Cl.
CPC *B41C 1/145* (2013.01); *B41C 1/144* (2013.01)

(58) Field of Classification Search
CPC ..... B41C 1/145; B41C 1/141; B41C 1/144; B41C 1/14; B41C 1/055
USPC ..... 101/128.4
See application file for complete search history.

(56) References Cited

U.S. PATENT DOCUMENTS 5,304,772 A * 4/1994 Snakenborg ..... B41C 1/145 148/241
5,359,928 A * 11/1994 Blessington ..... B41C 1/142 101/128.4
5,483,883 A * 1/1996 Hayama ..... B41N 1/245 101/119
5,687,646 A 11/1997 Sakaguchi
2004/0029048 A1* 2/2004 Frauchiger ..... B41B 17/00 430/307
2013/0199386 A1* 8/2013 Lynch ..... B41F 15/0881 101/123

FOREIGN PATENT DOCUMENTS

JP 06-270379 9/1994

* cited by examiner

*Primary Examiner* — Daniel J Colilla
*Assistant Examiner* — Ruben Parco, Jr.
(74) *Attorney, Agent, or Firm* — Hamre, Schumann, Mueller & Larson, P.C.

(57) ABSTRACT

In a thermal stencil-making machine, a thermosensitive stencil screen made by pasting a thermo sensitive material on a stencil-making side of a mesh screen for screen printing and a thermal perforator that perforates the thermosensitive stencil screen are relatively moved to each other to thermally perforate the thermosensitive material according to image information. The thermal stencil-making machine includes a residue remover that removes a melted residue generated on the stencil-making side of the thermosensitive stencil screen along a circumference of a perforated hole when the thermosensitive material is melted by the thermal perforator. The residue remover removes the melted residue while the thermosensitive stencil screen and the thermal perforator are relatively moved to each other.

5 Claims, 5 Drawing Sheets

THERMAL STENCIL-MAKING MACHINE

BACKGROUND OF THE INVENTION

1. Technical Field

The present invention relates to a thermal stencil-making machine.

2. Background Arts

In a thermal stencil-making machine, a thermosensitive stencil screen and a thermally-perforating head are moved relatively to each other to make a stencil screen plate (sheet) by thermally perforating the thermosensitive stencil screen by use of the thermally-perforating head based on image information. Generally, such a thermal stencil-making machine is commonly utilized, because its mechanism is simple and its stencil-making operation is easy.

A Patent Document 1 (Japanese Patent Application Publication No. H6-270379) discloses a thermal stencil-making machine for screen printing. It is noted in the Patent Document 1 that a stencil-making operation by the thermal stencil-making machine can be shortened and simplified, and a stencil screen plate can be made with high precision.

In the thermal stencil-making machine disclosed in the Patent Document 1, a screen holder frame that holds a stencil screen on which a thermosensitive material is pasted, and a platen are laid on a stencil-making table, and the stencil screen with the thermosensitive material and the platen are contacted with each other. Then, a thermally-perforating head is moved above the stencil-making table relatively to the screen holder frame to form perforated holes on the thermosensitive material by use of heats generated by heater elements of the thermally-perforating head. The stencil screen plate is composed of the perforated thermosensitive stencil screen and the screen holder frame that holds the perforated thermosensitive stencil screen.

Here, an above-mentioned screen on which a thermosensitive material is pasted is also called as a thermosensitive stencil screen. Such a thermosensitive stencil screen is generally made by pasting a thermosensitive material on (e.g. attaching a thermosensitive film to) a main surface side (stencil-making side) of a mesh screen for screen printing. The mesh screen is made by weaving warp and woof strands. A stencil screen plate (a perforated thermosensitive stencil screen and a screen holder frame) is used to print images on T-shirts, for example.

SUMMARY OF THE INVENTION

However, in the above-mentioned thermal stencil-making machine disclosed in the Patent Document 1, melted residues generated when a thermosensitive stencil screen is perforated by the thermally-perforating head adhere to circumferences of perforated holes, and thereby a failure of stencil making is caused by the melted residues.

When such a failure occurs, it is needed to remove the melted residues. Therefore, the stencil-making operation for making a screen stencil takes much time, and productivity of a screen stencil(s) may be degraded. In addition, if screen printing is done, e.g. on a T-shirt, with such a failed screen stencil plate with the melted residues, quality of printed images may degrade.

An object of the present invention is to provide a thermal stencil-making machine that can automatically removes melted residues that adhere to circumferences of perforated holes from a stencil-making side (main surface side) of a thermosensitive stencil screen, and can improve productivity.

An aspect of the present invention provides a thermal stencil-making machine in which a thermosensitive stencil screen made by pasting a thermosensitive material on a stencil-making side of a mesh screen for screen printing and a thermal perforator that perforates the thermosensitive stencil screen are relatively moved to each other to thermally perforate the thermosensitive material according to image information, the machine comprising: a residue remover that removes a melted residue generated on the stencil-making side of the thermosensitive stencil screen along a circumference of a perforated hole when the thermosensitive material is melted by the thermal perforator, wherein the residue remover removes the melted residue while the thermosensitive stencil screen and the thermal perforator are relatively moved to each other.

According to the aspect, the melted residue can be automatically removed while the thermosensitive stencil screen and the thermal perforator are relatively moved to each other. Therefore, image quality perforated on the thermosensitive stencil screen can be improved with respect to the image information due to the removal of the melted residue. In addition, printed image quality by the thermosensitive stencil screen can be also improved due to the removal of the melted residue. Further, productivity of stencil-making can be improved, because the melted residue can be automatically removed while the thermosensitive stencil screen and the thermal perforator are relatively moved to each other.

It is preferable that the residue remover includes a blade that scrapes the melted residue.

Alternatively, it is preferable that the residue remover includes a cleansing solution tank that supplies cleansing solution onto the stencil-making side of the thermosensitive stencil screen to cleanse the melted residue, and a dryer fan that dries the stencil-making side of the thermosensitive stencil screen after cleansing the melted residue. Here, it is further preferable that the residue remover further includes a residue scraping film that scrapes the melted residue remained after cleansing by the cleansing solution. It is furthermore preferable that the residue scraping film scrapes the melted residue before the stencil-making side of the thermosensitive stencil screen is dried by the dryer fan.

DESCRIPTION OF THE EMBODIMENT

Hereinafter, embodiments of a thermal stencil-making machine will be described with reference to the drawings.

First Embodiment

Figure 1:
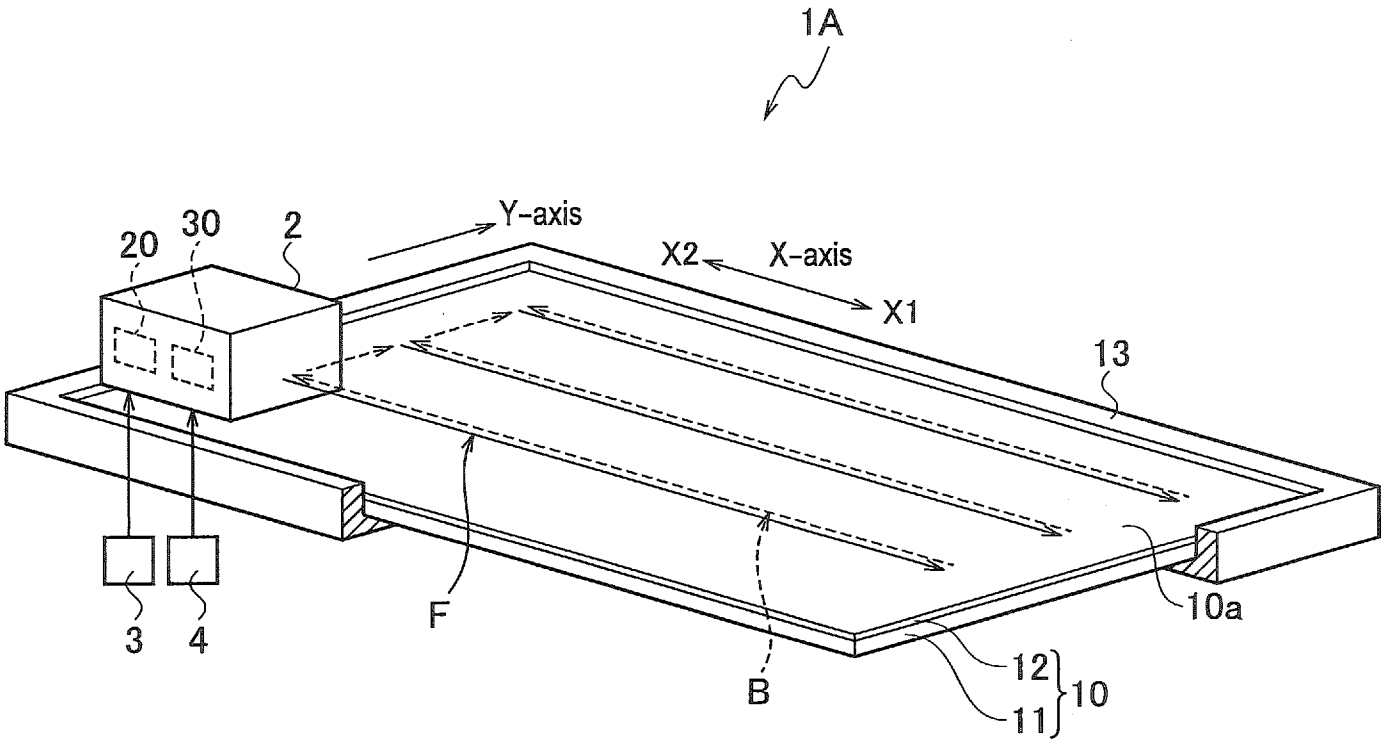
FIG. 1 is a perspective view of a thermal stencil-making machine according to a first embodiment.

A thermal stencil-making machine 1A according to a first embodiment will be described with reference to FIG. 1 to FIG. 3B. As shown in FIG. 1, a thermosensitive stencil screen 10 used in the thermal stencil-making machine 1A is formed by pasting a thermosensitive material 12 on a main surface side (stencil-making side) of a mesh screen 11 for screen printing that is made by weaving warp and woof strands. The thermo sensitive stencil screen 10 is attached to a rectangular screen holder frame 13.

Here, a thermosensitive film is adopted as the thermosensitive material 12. Since the thermosensitive film is attached onto the mesh screen 11 for screen printing, the thermosensitive material 12 is also referred as the thermosensitive film 12 hereinafter.

In addition, a casing box 2 is provided above a stencil-making side (main surface side) of the thermosensitive stencil screen 10. The casing box 2 accommodates a serial thermal head 20 and a residue remover 30. The serial thermal head 20 is a kind of thermal perforator, and perforates the thermosensitive film (thermosensitive material) 12 of the thermosensitive stencil screen 10 by heating the thermosensitive film (thermosensitive material) 12. The residue remover 30 removes melted residues 12*b* (see FIG. 2C) on the thermosensitive film 12 that are generated along circumferences of perforated holes 12*a* when the thermosensitive film 12 is perforated (melted). The residue remover 30 removes the melted residues 12*b* by a so-called blade method.

The thermosensitive stencil screen 10 held by the screen holder frame 13 and the casing box 2 accommodating the serial thermal head 20 and the residue remover 30 are moved relatively to each other along an X direction and a Y direction by an X-axis sweep mechanism 3 and a Y-axis sweep mechanism 4. Note that, in FIG. 1, a direction indicated by an arrow X1 shows a forward direction (see solid lines F), and a direction indicated by an arrow X2 shows a backward direction (see dotted lines B), when the casing box 2 is moved along the X-axis relatively to the stencil screen plate (=the thermosensitive stencil screen 10+the screen holder frame 13).

When relatively moving the thermosensitive stencil screen 10 and the serial thermal head 20 that serves as the thermal perforator to each other, the thermosensitive stencil screen 10 is stopped still and the casing box 2 (the serial thermal head 20) is moved relatively to the thermosensitive stencil screen 10 along the X-axis and the Y-axis in the present embodiment. However, it is also possible that the casing box 2 (the serial thermal head 20) is stopped still and the thermosensitive stencil screen 10 is moved relatively to the casing box 2. Of course, it is also possible that both of the thermo sensitive stencil screen 10 and the casing box 2 (the serial thermal head 20) are moved concurrently so that they are relatively moved to each other.

In the following descriptions, the casing box 2 accommodating the serial thermal head 20 and the residue remover 30 is moved along the X-axis in a reciprocated manner. With respect to the Y-axis, the casing box 2 is moved forward in a width direction of the thermosensitive stencil screen 10 from its initial position, and moved backward when it is returned to the initial position.

Figure 2A:
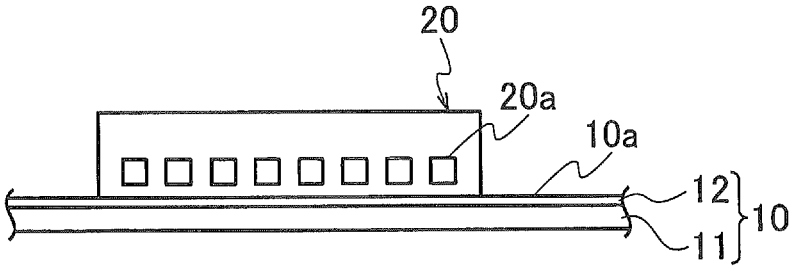
FIG. 2A is a side view of a thermally-perforating head of the stencil-making machine and a thermosensitive stencil screen (before perforation)
Figure 2B:
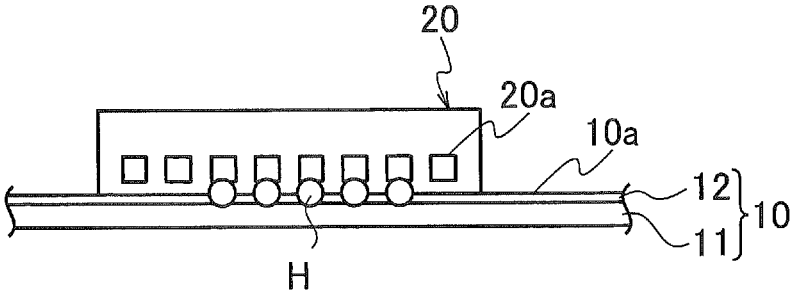
FIG. 2B is a side view of the thermally-perforating head and the thermosensitive stencil screen (during perforation)
Figure 2C:
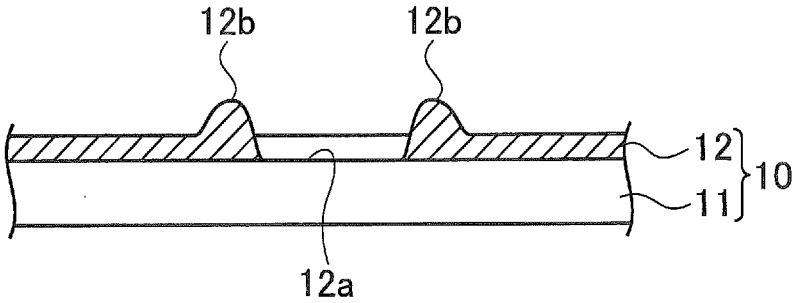
FIG. 2C is a cross-sectional view of the thermosensitive stencil screen that has been perforated by the stencil-making machine.

As shown in FIG. 2A, the serial thermal head 20 includes plural (e.g. eight) heater elements 20*a* along its width direction, and these heater elements 20*a* are disposed so as to face against a main surface 10*a* of the thermosensitive stencil screen 10. As shown in FIG. 2B, the heater elements 20*a* provided in the serial thermal head 20 are heated selectively according to image information for the stencil screen plate, and thereby the thermosensitive film 12 of the thermosensitive stencil screen 10 is perforated (melted). In this manner, the stencil screen plate (the perforated thermosensitive stencil screen 10+the screen holder frame 13) is made. Note that FIG. 2B schematically shows heats H generated by the heater elements 20*a*.

Figure 3A:
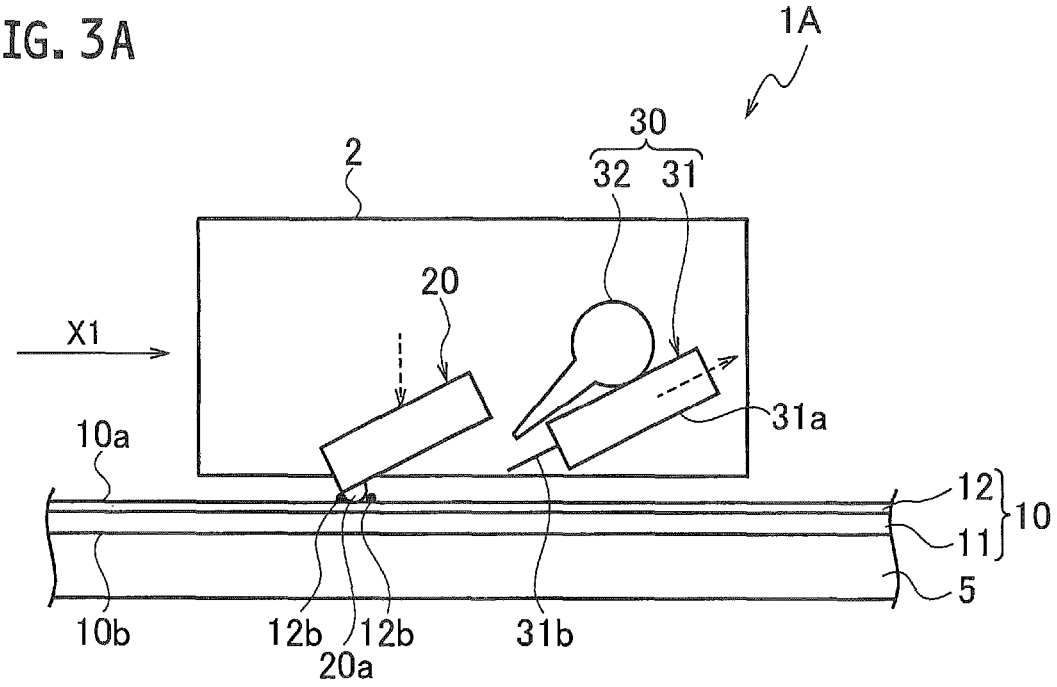
FIG. 3A is an enlarged side view of the thermally-perforating head and the thermosensitive stencil screen (forward sweeping)
Figure 3B:
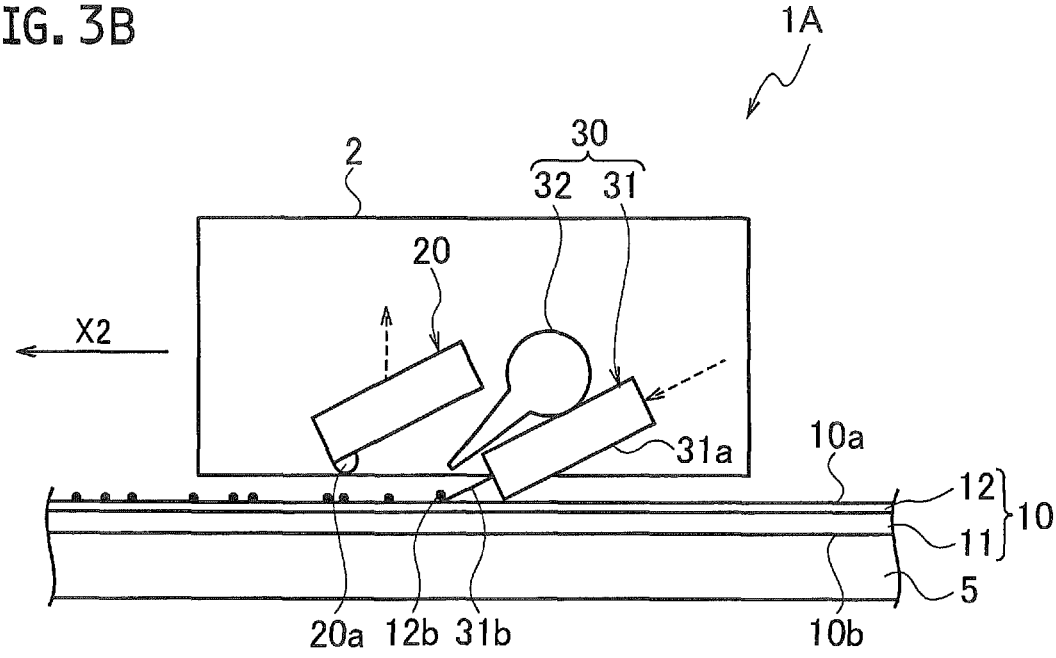
FIG. 3B is an enlarged side view of the thermally-perforating head and the thermosensitive stencil screen (backward sweeping)

The configuration and operation of the thermal stencil-making machine 1A will be described more in detail. As shown in FIG. 3A and FIG. 3B, the serial thermal head 20 that is a kind of thermal perforator is provided above the main surface 10*a* of the thermosensitive stencil screen 10 so as to be made closer-to and distanced-from the thermosensitive film 12 (the main surface 10*a*) of the thermosensitive stencil screen 10 by a first shifting mechanism (not shown in the drawings).

In addition, the residue remover 30 includes a blade member 31 and a suction fan 32. The blade member 31 and the suction fan 32 are also provided above the main surface 10*a* of the thermosensitive stencil screen 10. The blade member 31 is disposed so that its lower end is directed toward a side of the serial thermal head 20. The suction fan 32 is also disposed so that its lower end is directed toward a side of the serial thermal head 20. The residue remover 30 is disposed on a forward side from the serial thermal head, so that it is located on a leading side from the serial thermal head 20 in the forward direction X1 (see FIG. 3A) and is located on a trailing side from the serial thermal head 20 in the backward direction X2 (see FIG. 3B).

The blade member 31 is provided so as to be made closer-to and distanced-from the thermosensitive film 12 of the thermosensitive stencil screen 10 by a second shifting mechanism (not shown in the drawings). The blade member 31 includes a blade holder 31*a* and a blade 31*b*. The blade 31*b* is made from a stainless plate almost 0.2 mm thick. The blade 31*b* has a width corresponding to a width of the serial thermal head 20, and is attached to the lower end of the blade holder 31*a*.

The blade member 31 has a function for automatically scraping the melted residues 12*b* generated on the main surface 10*a* of the thermosensitive stencil screen 10 by contacting an end edge of the blade 31*b* with the main surface 10*a* of the thermosensitive stencil screen 10. The suction fan 32 is installed integrally with the blade member 31, and has a function for suctioning the melted residues scraped by the blade 31*b* of the blade member 31.

In addition, a platen 5 having a flat planar shape is provided on a side of a back surface 10*b* of the thermosensitive stencil screen 10, if needed. The platen 5 is not necessarily required, and a platen roller having a cylindrical shape may be used instead of the platen 5.

When making the stencil screen plate by the thermal stencil-making machine 1A as shown in FIG. 3A, the heater elements 20*a* of the serial thermal head 20 accommodated in the casing box 2 are contacted with the main surface 10*a* of the thermosensitive stencil screen 10, and then the casing box 2 is moved with a predetermined speed V1 in the forward direction X1 while the blade 31*b* of the blade member 31 of the residue remover 30 is distanced from the main surface 10*a* of the thermosensitive stencil screen 10.

While moving the serial thermal head 20 in the forward direction X1 integrally with the casing box 2, the stencil screen plate is made by perforating the thermosensitive film 12 by use of the heater elements 20*a* provided in the serial thermal head 20. At this process, the above-described melted residues 12*b* may be generated on the main surface 10*a* of the thermosensitive stencil screen 10.

After the above-described perforation of the thermosensitive stencil screen 10, the casing box 2 is moved in the backward direction X2 as shown in FIG. 3B, while the heater elements 20*a* of the serial thermal head 20 accommodating in the casing box 2 are distanced from the main surface 10*a* of the thermosensitive stencil screen 10 and the blade 31*b* of the blade member 31 of the residue remover 30 accommodated in the casing box 2 is contacted with the main surface 10*a* of the thermosensitive stencil screen 10.

As the result, the melted residues 12*b* generated on the main surface 10*a* of the thermosensitive stencil screen 10 are automatically scraped (removed) by the blade 31*b* of the blade member 31 as shown in FIG. 3B while the blade member 31 is moved in the backward direction X2 integrally with the casing box 2. Concurrently, the removed melted residues 12*b* are suctioned by the suction fan 32.

At this process, productivity of the stencil screen plate(s) can be improved by making a speed V2 for moving the casing box 2 in the backward direction X2 while removing the melted residues 12*b* faster than the speed V1 for moving the casing box 2 in the forward direction X1 while making the stencil screen plate (V2>V1).

A high-quality image can be printed, e.g. on a T-shirt, when using the stencil screen plate in which the melted residues 12*b* are removed from the main surface 10*a* of the thermosensitive stencil screen 10.

Since the residue remover 30 that uses the blade 31*b* of the blade member 31 is structurally simple, the thermal stencil-making machine 1A can be provided at low costs.

Next, a thermal stencil-making machine 1B according to a modified example of the first embodiment will be described with reference to FIG. 4A and FIG. 4B. Note that the fundamental configuration of the thermal stencil-making machine 1B in the present modified example is identical to that of the above-described thermal stencil-making machine 1A of the first embodiment. Therefore, different configurations between them will be explained hereinafter.

Figure 4A:
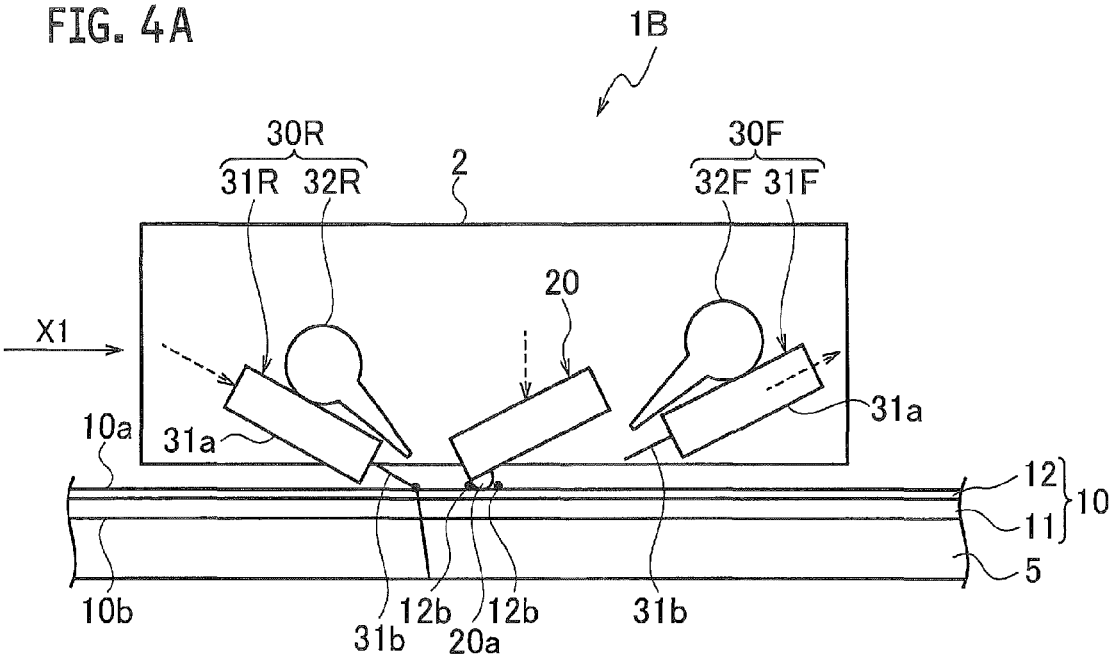
FIG. 4A is an enlarged side view of a thermally-perforating head of a thermal stencil-making machine according to a modified example of the first embodiment and a thermosensitive stencil screen (forward sweeping)
Figure 4B:
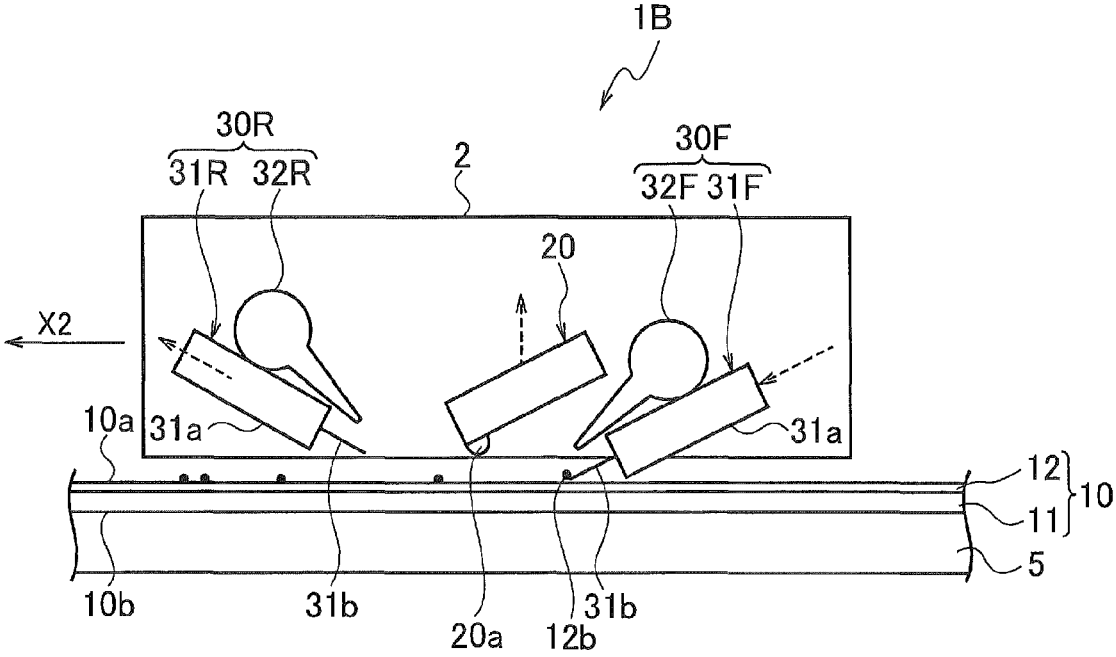
FIG. 4B is an enlarged side view of the thermally-perforating head and the thermosensitive stencil screen (backward sweeping)

As shown in FIG. 4A and FIG. 4B, in the thermal stencil-making machine 1B, the casing box 2 is provided above a stencil-making side (main surface side) of the thermosensitive stencil screen 10 similarly to the first embodiment. However, the casing box 2 accommodates the serial thermal head 20 and a pair of residue removers 30F and 30R. The serial thermal head 20 is located between the residue removers 30F and 30R along the X-axis direction, and the residue removers 30F and 30R are disposed symmetrically with respect to the center of them.

The residue remover 30F located on a forward side (a leading side in the forward direction X1: a trailing side in the backward direction X2) includes a blade member 31F and a suction fan 32F. Similarly, the residue remover 30R located on a backward side (a trailing side in the forward direction X1: a leading side in the backward direction X2) includes a blade member 31R and a suction fan 32R. The blade members 31F and 31R are disposed oppositely so that each lower end of them is directed toward a side of the serial thermal head 20. The suction fans 32F and 32R are also disposed oppositely so that each lower end of them is directed toward a side of the serial thermal head 20.

In the present modified example, the melted residues 12*b* generated on the main surface 10*a* of the thermosensitive stencil screen 10 are scraped (removed) in both of the forward sweeping and the backward sweeping of the casing box 2, differently from the above-described first embodiment.

When making the stencil screen plate by the thermal stencil-making machine 1B as shown in FIG. 4A, the heater elements 20*a* of the serial thermal head 20 accommodated in the casing box 2 are contacted with the main surface 10*a* of the thermosensitive stencil screen 10, and then the casing box 2 is moved with a predetermined speed V1 in the forward direction X1 while the blade 31*b* of the blade member 31F of the residue remover 30F on the forward side is distanced from the main surface 10*a* of the thermosensitive stencil screen 10 but the blade 31*b* of the blade member 31R of the residue remover 30R on the backward side is contacted with the main surface 10*a* of the thermosensitive stencil screen 10.

While moving the serial thermal head 20 in the forward direction X1 integrally with the casing box 2, the stencil screen plate is made by perforating the thermosensitive film 12 by use of the heater elements 20*a* provided in the serial thermal head 20, and, concurrently, the melted residues 12*b* generated on the main surface 10*a* of the thermosensitive stencil screen 10 are automatically scraped (removed) by the blade 31*b* of the blade member 31R on the backward side as shown in FIG. 4A. Concurrently, the removed melted residues 12*b* are suctioned by the suction fan 32R on the backward side.

After the above-described perforation of the thermosensitive stencil screen 10, the casing box 2 is moved in the backward direction X2 as shown in FIG. 4B, while the heater elements 20*a* of the serial thermal head 20 accommodating in the casing box 2 are distanced from the main surface 10*a* of the thermosensitive stencil screen 10, and the blade 31*b* of the blade member 31R of the residue remover 30R that is located on the backward side and accommodated in the casing box 2 is also distanced from the main surface 10*a* of the thermosensitive stencil screen 10 and the blade 31*b* of the blade member 31F of the residue remover 30F that is located on the forward side and accommodated in the casing box 2 is contacted with the main surface 10*a* of the thermosensitive stencil screen 10. The casing box 2 is moved in the backward direction X2 by a faster speed V2 than the speed V1 of the forward direction.

The melted residues 12*b* remained after the forward sweeping of the casing box 2 are automatically scraped (removed) by the blade 31*b* of the blade member 31F on the forward side as shown in FIG. 4B. Concurrently, the removed melted residues 12*b* are suctioned by the suction fan 32F on the forward side.

According to the present modified example, the number of the residue removers 30F and 30R increases more than that in the first embodiment, but the melted residues 12*b* are removed in both of the forward seeping and the backward sweeping of the casing box 2 and thereby the melted residues 12*b* can be removed more surely than in the first embodiment.

According to the above-described thermal stencil-making machines 1A and 1B, the melted residues 12*b* are removed by the residue remover(s) (30, 30F and 30R) in at least one of the forward weeping or the backward sweeping of the thermal perforator (serial thermal head) 20 relative to the thermosensitive stencil screen 10. Therefore, the melted residues 12*b* are automatically removed from the main surface 10*a* of the thermo sensitive stencil screen 10, and thereby image quality can be improved with respect to image information of the stencil screen plate that is perforated on the thermosensitive stencil screen 10 and a failure in stencil-making of the stencil screen plate can be avoided.

In addition, the melted residues 12*b* are removed while the thermal perforator (serial thermal head) 20 is moved relatively to the thermosensitive stencil screen 10, so that the stencil-making process can be made shorter than that by the conventional method described in the "Background Arts" section (the melted residues are removed in another process after the stencil-making process). As the result, productivity of the stencil screen plate(s) can be improved.

Second Embodiment

A thermal stencil-making machine 1C according to a second embodiment will be described with reference to FIG. 5A and FIG. 5B. Note that the fundamental configuration of the thermal stencil-making machine 1C in the present embodiment is identical to that of the above-described thermal stencil-making machine 1A of the first embodiment. Therefore, different configurations between them will be explained hereinafter.

Figure 5A:
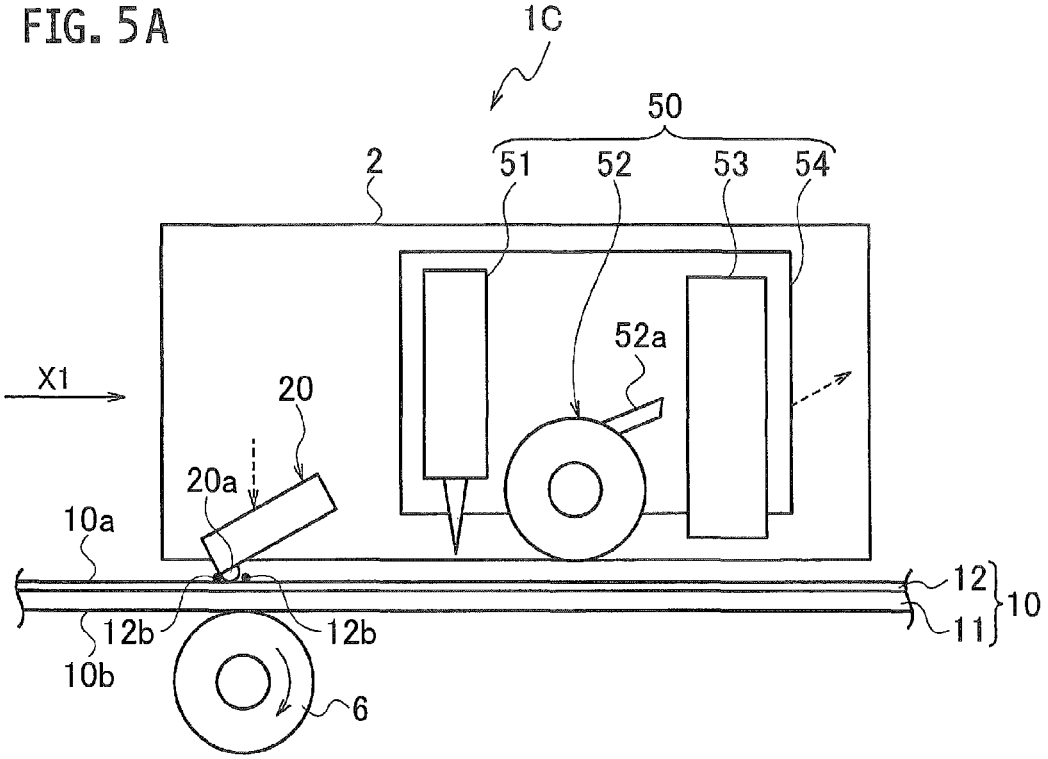
FIG. 5A is an enlarged side view of a thermally-perforating head of a thermal stencil-making machine according to a second embodiment and a thermosensitive stencil screen (forward sweeping)
Figure 5B:
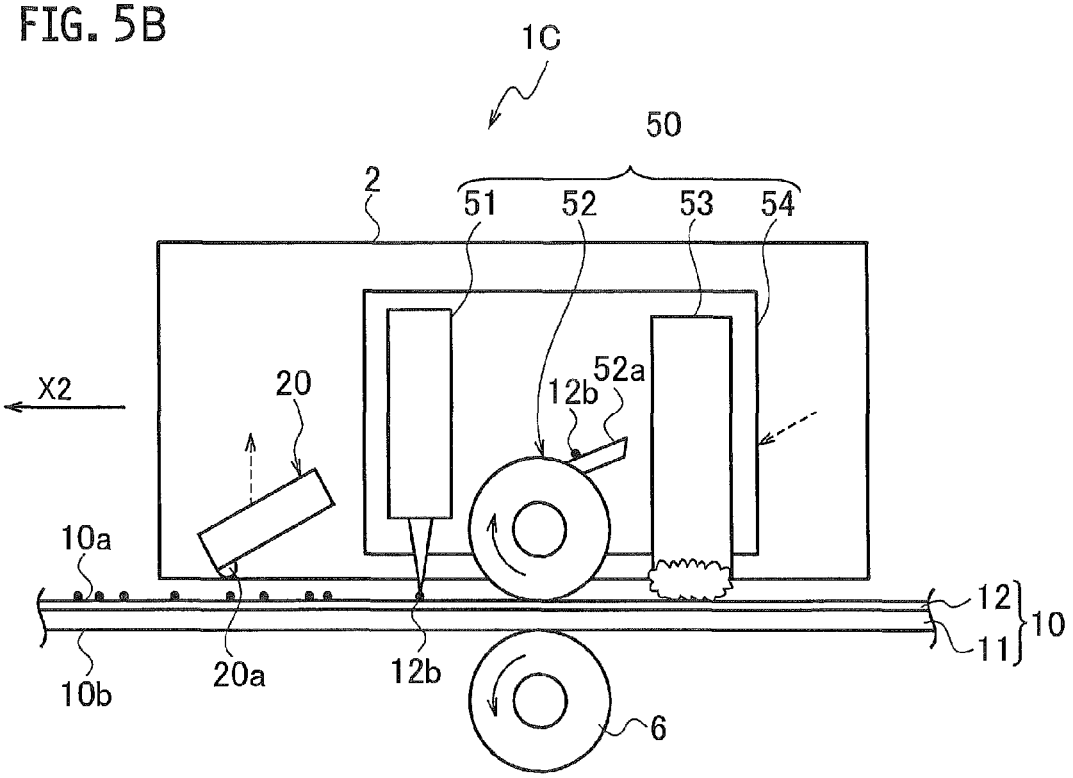
FIG. 5B is an enlarged side view of the thermally-perforating head and the thermosensitive stencil screen (backward sweeping).

As shown in FIG. 5A and FIG. 5B, in the thermal stencil-making machine 1C, the casing box 2 is provided above a stencil-making side (main surface side) of the thermosensitive stencil screen 10 similarly to the first embodiment. However, the casing box 2 accommodates the serial thermal head 20 and a residue remover 50 that removes the melted residues 12*b* in a cleansing manner.

The thermosensitive stencil screen 10 held by the screen holder frame 13 (see FIG. 1) and the casing box 2 accommodating the serial thermal head 20 and the residue remover 50 are moved relatively to each other along the X direction and the Y direction by the X-axis sweep mechanism 3 and the Y-axis sweep mechanism 4 (see FIG. 1). Also in the present embodiment, the heater elements 20*a* of the serial thermal head 20 are provided so as to be made closer-to and distanced-from the thermosensitive film 12 (the main surface 10*a*) of the thermosensitive stencil screen 10 by the first shifting mechanism (not shown in the drawings).

The residue remover 50 has a different configuration from that of the residue remover 30 in the first embodiment, and includes a cleansing solution tank 51, a residue collecting roller 52, a dryer fan 53 and a support frame 54. The cleansing solution tank 51 contains cleansing solution for the melted residues 12*b*. An elastically-deformable residue scraping film 52*a* is attached to an outer circumferential surface of the residue collecting roller 52. The support frame 54 supports the cleansing solution tank 51, the residue collecting roller 52 and the dryer fan 53. The residue remover 50 is provided so as to be made closer-to and distanced-from the thermosensitive film 12 (the main surface 10*a*) of the thermosensitive stencil screen 10 by a third shifting mechanism (not shown in the drawings).

The residue remover 50 is disposed on a forward side from the serial thermal head, so that it is located on a leading side from the serial thermal head 20 in the forward direction X1 (see FIG. 5A) and is located on a trailing side from the serial thermal head 20 in the backward direction X2 (see FIG. 5B).

In addition, a platen roller 6 having a cylindrical shape is provided on a side of the back surface 10*b* of the thermosensitive stencil screen 10 so as to be associated with the residue collecting roller 52, if needed. The platen roller 6 is not necessarily required, and a platen having a flat planar shape may be used instead of the platen roller 6.

When making the stencil screen plate by the thermal stencil-making machine 1C as shown in FIG. 5A, the heater elements 20*a* of the serial thermal head 20 accommodated in the casing box 2 are contacted with the main surface 10*a* of the thermosensitive stencil screen 10, and then the casing box 2 is moved with a predetermined speed V1 in the forward direction X1 while the residue collecting roller 52 of the residue remover 50 is distanced from the main surface 10*a* of the thermosensitive stencil screen 10.

While moving the serial thermal head 20 in the forward direction X1 integrally with the casing box 2, the stencil screen plate is made by perforating the thermosensitive film 12 by use of the heater elements 20*a* provided in the serial thermal head 20. At this process, the above-described melted residues 12*b* may be generated on the main surface 10*a* of the thermosensitive stencil screen 10.

After the above-described perforation of the thermosensitive stencil screen 10, the casing box 2 is moved in the backward direction X2 as shown in FIG. 5B, while the heater elements 20*a* of the serial thermal head 20 accommodating in the casing box 2 are distanced from the main surface 10*a* of the thermosensitive stencil screen 10 and the thermosensitive stencil screen 10 is pinched by the residue collecting roller 52 of the residue remover 50 accommodated in the casing box 2 and the platen roller 6 (i.e. the residue collecting roller 52 is contacted with the main surface 10*a* of the thermosensitive stencil screen 10). The casing box 2 is moved in the backward direction X2 by a faster speed V2 than the speed V1 of the forward direction.

Concurrently, the cleansing solution is dripped from the cleansing solution tank 51 of the residue remover 50 onto the main surface 10*a* of the thermosensitive stencil screen 10 to cleanse the melted residues 12*b* generated on the main surface 10*a*, and the melted residues 12*b* remained after cleansing by the cleansing solution are scraped (removed) by the residue scraping film 52*a* adhered on the outer circumferential surface of the residue collecting roller 52. And then, the main surface 10*a* of the thermosensitive stencil screen 10 is dried by the dryer fan 53. In this manner, the stencil screen plate is made.

According to the above-described thermal stencil-making machine 1C, the melted residues 12*b* generated on the main surface 10*a* of the thermo sensitive stencil screen 10 are cleansed by the cleansing solution supplied from the cleansing solution tank 51 and further scraped (removed) by the residue scraping film 52*a* of the residue collecting roller 52, and then the thermo sensitive stencil screen 10 is dried by the dryer fan 53 in the backward sweeping of the casing box 2. Therefore, the melted residues 12*b* can be removed surely from the main surface 10*a* of the thermosensitive stencil screen 10, and superior finishing of the stencil screen plate (the main surface 10*a*) can be brought.

A high-quality image can be printed, e.g. on a T-shirt, when using the stencil screen plate in which the melted residues 12*b* are removed from the main surface 10*a* of the thermosensitive stencil screen 10.

Note that the thermal stencil-making machine 1C according to the present embodiment can be modified so that the melted residues 12*b* are removed by use of the cleansing solution supplied from the cleansing solution tank 51 in both of the forward sweeping and the back ward sweeping of the casing box 2.

In the above-described thermal stencil-making machines 1A to 1C, the serial thermal head 20 that serves as the thermal perforator is moved along the X direction and the Y direction. However, a line thermal head may serve as the thermal perforator instead of the serial thermal head 20. In such a line thermal head, a lot of the heater elements 20*a* are aligned in a width direction (the Y direction) of the thermosensitive stencil screen 10.

When adopting a line thermal head, it is not needed to move the line thermal head in the Y direction. Therefore, the residue remover(s) (30, 30F and 30R, and 50) may remove the melted residues 12*b* in at least one of the forward sweeping in which the line thermal head and the thermosensitive stencil screen 10 are moved relatively to each other in the X direction from its initial position and the backward sweeping in which the line thermal head are moved back to the initial position relatively to the thermosensitive stencil screen 10.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefit of a priority under 35 U.S.C. §119 to Japanese Patent Application No. 2014-165925, filed on Aug. 18, 2014, the entire content of which is incorporated herein by reference.

What is claimed is:

1. A thermal stencil-making machine in which a thermosensitive stencil screen made by pasting a thermosensitive material on a stencil-making side of a mesh screen for screen printing and a thermal perforator that perforates the thermosensitive stencil screen are relatively moved to each other to thermally perforate the thermosensitive material according to image information, the machine comprising:

the thermal perforator;

a residue remover that removes a melted residue generated on the stencil-making side of the thermosensitive stencil screen along a circumference of a perforated hole when the thermosensitive material is melted by the thermal perforator, wherein the residue remover removes the melted residue while the thermosensitive stencil screen and the thermal perforator are relatively moved to each other.

2. The thermal stencil-making machine according to claim 1, wherein the residue remover includes a blade that scrapes the melted residue.

3. The thermal stencil-making machine according to claim 1, wherein the residue remover includes a cleansing solution tank that supplies cleansing solution onto the stencil-making side of the thermosensitive stencil screen to cleanse the melted residue, and a dryer fan that dries the stencil-making side of the thermosensitive stencil screen after cleansing the melted residue.

4. The thermal stencil-making machine according to claim 3, wherein the residue remover further includes a residue scraping film that scrapes the melted residue remained after cleansing by the cleansing solution.

5. The thermal stencil-making machine according to claim 4, wherein the residue scraping film scrapes the melted residue before the stencil-making side of the thermosensitive stencil screen is dried by the dryer fan.

* * * * *